United States Patent [19]

Nishikawa et al.

[11] 4,148,577

[45] Apr. 10, 1979

[54] BIAS VOLTAGE ADJUSTING MEANS FOR ELECTROGRAPHIC APPARATUS

[75] Inventors: Masaji Nishikawa; Muneo Kasuga, both of Hachioji, Japan

[73] Assignee: Olympus Optical Company Limited, Tokyo, Japan

[21] Appl. No.: 826,673

[22] Filed: Aug. 22, 1977

[30] Foreign Application Priority Data

Sep. 2, 1976 [JP] Japan ..... 51/104223

[51] Int. Cl.[2] ..... G03G 15/00

[52] U.S. Cl. ..... 355/35 C; 355/14

[58] Field of Search ..... 355/35 C, 3 R, 14; 96/1 R

[56] References Cited

U.S. PATENT DOCUMENTS

| | | | |
|---|---|---|---|
| 3,942,980 | 3/1976 | Hou | 355/35 C |
| 4,006,983 | 2/1977 | Pressman et al. | 355/35 C |

FOREIGN PATENT DOCUMENTS

| | | | |
|---|---|---|---|
| 2653793 | 6/1977 | Fed. Rep. of Germany | 355/35 C |

*Primary Examiner*—R. L. Moses

*Attorney, Agent, or Firm*—Haseltine, Lake & Waters

[57] ABSTRACT

An electrographic apparatus comprising a photosensitive screen composed of an insulating layer, two electrically conductive layers coated on opposite sides of the insulating layer and a photosensitive layer coated on one of said electrically conductive layers, and a bias electric source connected between the two electrically conductive layers and producing, on a dielectric coated record sheet, an electrostatic latent image corresponding to an image to be reproduced is disclosed. The apparatus comprises means for adjusting a bias voltage supplied from the bias electric source and applied between the two electrically conductive layers.

7 Claims, 9 Drawing Figures

BIAS VOLTAGE ADJUSTING MEANS FOR ELECTROGRAPHIC APPARATUS

BACKGROUND OF THE INVENTION

1. Field of the Invention

This invention relates to an electrographic apparatus comprising a photosensitive screen composed of an insulating layer, two electrically conductive layers coated on opposite sides of the insulating layer and a photosensitive layer coated on one of the electrically conductive layers, a corona discharge device arranged at one side of the photosensitive screen and emitting a flow of corona ions, and a dielectric coated record sheet arranged at the other side of the photosensitive screen, whereby an electrostatic latent image produced on the photosensitive layer of the photosensitive screen causes the flow of corona ions directed from the corona discharge device through the photosensitive screen toward the dielectric coated record sheet to modulate so as to produce, on the dielectric coated record sheet, an electrostatic charge image corresponding to the electrostatic latent image on the photosensitive layer of the photosensitive screen.

2. Description of the Prior Art

Various kinds of electrographic apparatus have been proposed which can modulate a flow of corona ions by an electrostatic latent image produced on a photosensitive screen so as to produce on a dielectric coated record sheet an electrostatic charge image.

One of these prior art apparatus makes use of a photosensitive screen of four layer construction composed of an insulating layer, two electrically conductive layers coated on opposite sides of the insulating layer and a photosensitive layer coated on one of the electrically conductive layers. Such apparatus can perform a first step of uniformly charging the photosensitive layer, a second step of illuminating the photosensitive screen with a light image and producing thereon an electrostatic latent image, and a third step of applying a high voltage between a field electrode arranged at the rear of a dielectric coated record sheet which is opposed to and spaced apart from the photosensitive layer of the photosensitive screen on the one hand and the photosensitive layer of the photosensitive screen on the other hand and directing a flow of corona ions from a corona discharge device arranged at the side of the electrically conductive layer of the photosensitive screen through the photosensitive screen toward the dielectric coated record sheet while applying a bias voltage between the two electrically conductive layers and producing on the dielectric coated record sheet an electrostatic charge image corresponding to the electrostatic latent image produced on the photosensitive layer of the photosensitive screen.

This apparatus has the advantage that the picture image can be controlled by adjusting the bias voltage applied between the two electrically conductive layers in dependence with the number of copies set beforehand and that a plurality of copies can be reproduced by repeating the third step after the electrostatic latent image has been produced on the photosensitive screen.

In practice, however, a concentration of the picture image becomes changed in dependence with the number of copies set beforehand owing to a dark decay characteristic of the photosensitive layer and to an undesirous detour of the flow of corona ions emitted from the corona discharge device. As a result, copies each having a picture image having a good quality are limited in number and it is impossible to obtain a large number of copies each of good quality.

In order to obviate such drawback, another prior art electrographic apparatus has been proposed. In this apparatus, in the above mentioned third step, the bias voltage applied between the electrically conductive layers of the photosensitive screen can be changed in response to the number of copies set beforehand and hence can compensate for the decay of the electrostatic latent image on the photosensitive layer. In such electrographic apparatus constructed as above described, in the case of obtaining a plurality of copies from the electrostatic latent image produced on the photosensitive screen by repeating the third step, if the concentration of the first picture image becomes incorrect, the concentration of subsequent picture images becomes also incorrect.

SUMMARY OF THE INVENTION

An object of the invention, therefore, is to provide an electrographic apparatus which can change the reproduction property of subsequent picture image in dependence with the concentration of the first reproduced picture image.

Another object of the invention is to provide an electrographic apparatus which can select an intermediate concentration tone reproduction property of successive picture images to be reproduced.

A feature of the invention is the provision, in an electrographic apparatus comprising a photosensitive screen composed of an insulating layer, two electrically conductive layers coated on opposite sides of the insulating layer and a photosensitive layer coated on one of the electrically conductive layers, a corona discharge device arranged at one side of the photosensitive screen and emitting a flow of corona ions, and a dielectric coated record sheet arranged at the other side of the photosensitive screen, whereby an electrostatic latent image produced on the photosensitive layer of the photosensitive screen causes the flow of corona ions directed from the corona discharge devices through the photosensitive screen toward the dielectric coated record sheet to modulate so as to produce, on the dielectric coated record sheet, an electrostatic charge image corresponding to the electrostatic latent image on the photosensitive layer of the photosensitive screen, of the improvement comprising means for adjusting a bias voltage applied between the two electrically conductive layers of the photosensitive screen.

DESCRIPTION OF THE PREFERRED EMBODIMENTS

Figure 1B:
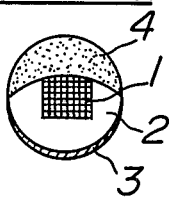
FIG. 1B PRIOR ART
FIGS. 1A and 1B are sectional elevational views showing two examples of a four layer construction of a photosensitive screen applicable to an electrographic apparatus according to the invention.
Figure 1A:
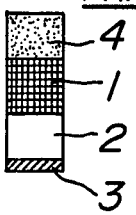
FIG. 1A PRIOR ART

In FIGS. 1A and 1B are shown, in section, two examples of a photosensitive screen applicable to an electrographic apparatus according to the invention. Each of these photosensitive screens is of four layer construction composed of a mesh-shaped electrically conductive core 1 which is coated on one side with an insulating layer 2 and an electrically conductive layer 3 in the order as mentioned and coated on the other side with a photosensitive layer 4.

Figure 2A:
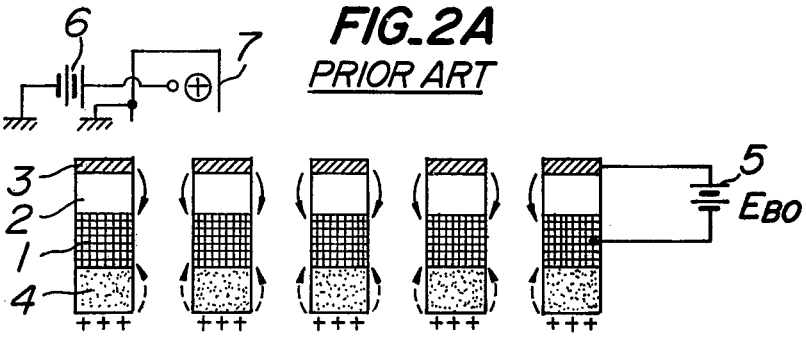
FIG. 2A PRIOR ART
FIGS. 2A to 2C are sectional elevational views of the photosensitive screen shown in FIG. 1A illustrating successive steps of reproducing copies of a prior art electrographic apparatus.
Figure 2B:
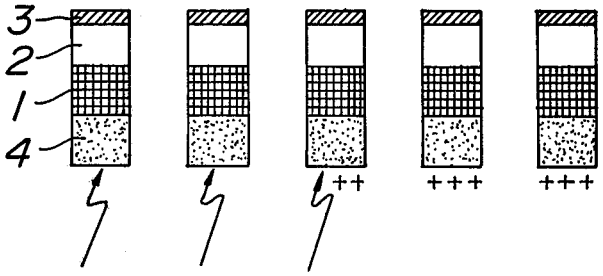
FIG. 2B PRIOR ART
Figure 2C:
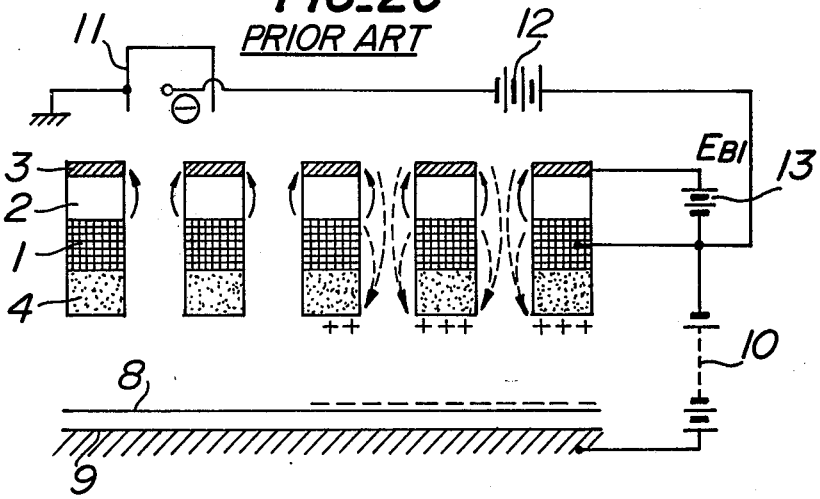
FIG. 2C PRIOR ART

In FIGS. 2A to 2C are illustrated successive steps of modulating a flow of corona ions by means of an electrostatic latent image produced on the photosensitive screen shown in FIG. 1A and then producing an electrostatic charge image on a dielectric coated record sheet. As shown in FIG. 2A, at first, between the electrically conductive core 1 and the electrically conductive layer 3 is connected a bias electric source 5 for supplying a voltage of $E_{B0}$. The photosensitive layer 4 is uniformly charged with a desired potential by a corona discharge device 7 connected to a corona electric source 6. In the example shown in FIG. 2A, the photosensitive layer 4 is uniformly charged by the corona discharge device 7 arranged at the side of the electrically conductive layer 3. But, the photosensitive layer 4 may also be uniformly charged by a corona discharge device arranged at the side of the photosensitive layer 4. In the above mentioned first charging step, the bias electric source 5 also functions to uniformly charge the photosensitive layer 4 with the desired potential. But, the first charging step may be carried out without using the bias electric source 5.

In FIG. 2B is illustrated a second step of illuminating the photosensitive layer 4 with a light image as shown by arrows. In the imagewise exposed area of the photosensitive layer 4, its resistance value becomes decreased to decrease or eliminate the charge produced thereon. In the dark area of the photosensitive layer 4, its high resistance is kept as it is, thus retaining its charge produced thereon. In this way, an electrostatic latent image corresponding to the light image is produced on the photosensitive layer 4.

In FIG. 2C is illustrated a third step which makes use of a dielectric coated record sheet 8 and a field electrode 9 opposed to and separated from the photosensitive layer 4 of the photosensitive screen. Between the photosensitive screen and the field electrode 9 is connected an accelerating electric source 10 so as to apply a high voltage therebetween. A flow of corona ions is directed from a second corona discharge device 11 through the photosensitive screen toward the dielectric coated record sheet 8. In this case, a polarity of a corona electric source 12 connected to the second corona discharge device 11 is made opposite to that of the corona electric source 6 connected to the first corona discharge device 7. As a result, the force produced on the photosensitive screen mesh 1 acts on the flow of corona ions in the directions shown by the arrows. That is, in the dark area of the photosensitive layer 4 where the charge remains, the flow of corona ions are directed in a direction for promoting its passage therethrough as shown by the dotted line arrows. In the imagewise exposed area of the photosensitive layer 4 where no is present, the flow of corona ions are prevented from passing therethrough as shown by full line arrows. In this case, the force for preventing the flow of corona ions from passing through the photosensitive screen is determined by a bias voltage $E_{B1}$ applied from the bias electric source 13 between the two electrically conductive layers 1, 3 of the photosensitive screen. The action of promoting the passage of the flow of corona ions through the photosensitive screen is determined by the value obtained by subtracting the bias voltage $E_{B1}$ applied between the two electrically conductive layers 1, 3 from the surface potential built up on the photosensitive layer 4.

The above described electrographic apparatus is capable of obtaining a plurality of copies from the electrostatic latent image which has been produced on the photosensitive screen by repeating the third step shown in FIG. 1C.

The electrographic apparatus according to the invention makes use of means for adjusting the bias voltage. This means for adjusting the bias voltage may be mounted on an operation panel of the electrographic apparatus and may be manually operated so as to change the bias voltage as will be described with reference to one embodiment of the invention. Alternatively, the means for adjusting the bias voltage may be automatically operated in response to the amount of light in an optical path or in response to an electric potential built up on the electrostatic latent image produced on the photosensitive screen. In this way, the invention is capable of changing the bias voltage in response to occurrence of a picture image having an incorrect concentration and hence of reproducing a picture image having a correct concentration.

Figure 3:
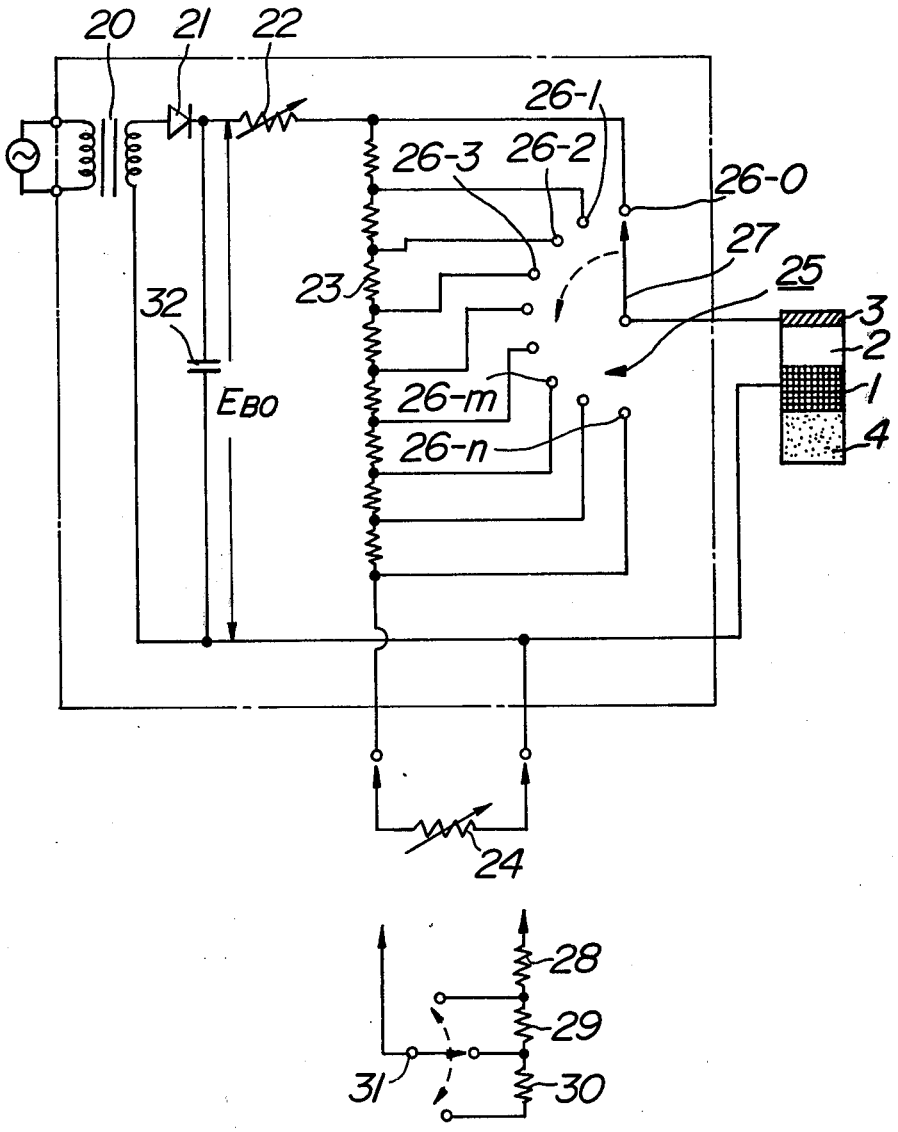
FIG. 3 is a circuit diagram of one embodiment of an electrographic apparatus according to the invention.

In FIG. 3 is shown one embodiment of a bias electric source circuit for a photosensitive screen of an electrographic apparatus according to the invention.

In the present embodiment, provision is made for a transformer 20 which functions to supply a suitable bias voltage to a photosensitive screen. The transformer has a secondary winding across which are connected, in series, a diode 21, a variable resistor 22, a voltage dividing resistor 23, and a variable resistor 24 for correcting the bias voltage. In parallel with the secondary winding of the transformer 20 and the diode 21 is connected a smoothing condenser 32. The voltage dividing resistor 23 is provided with a number of taps which are connected to contacts 26-1, 26-2, 26-3, . . . 26-m . . . 26-(n−1), respectively, of a rotary switch 25. Both terminals of the voltage dividing resistor 23 are connected to contacts 26-0 and 26-n, respectively, of the rotary switch 23. A change-over arm 27 of the rotary switch 25 is connected to an electrically conductive layer 3 of a photosensitive screen whose electrically conductive mesh 1 is connected to that terminal of the secondary winding of the transformer 20 which is connected to the bias correcting variable resistor 24. The diode 21 is connected in such polarity that a positive voltage is applied to the electrically conductive layer 3 and that a negative voltage is applied to the electrically conductive mesh 1. The variable resistor 22 operates to adjust the charge characteristic of the photosensitive screen, electric source circuit, etc. after the photosensitive screen has been exposed. The voltage dividing resistor 23 operates to change the bias voltage in response to the number of copies set beforehand when a number of copies is to be reproduced from one manuscript.

In the case of reproducing a first copy, the change-over arm 27 is connected to the contact 26-1. In the case of reproducing a second, a third . . . copy, the change-over arm 27 is connected to the contact 26-2, 26-3 . . . in succession. The change-over arm 27 is interlocked with a switch for selecting the number of copies set beforehand such that the change-over arm 27 is automatically connected to successive contacts in response to the number of copies set beforehand. In this way, it is possible to change the bias voltage in response to the number of copies set beforehand and to obtain a substantially constant picture image concentration irrespective of changes of the surface potential built up on the electrostatic latent image owing to the reproduction of copies. In this case, however, if the concentration of the first picture image reproduced is not correct, all of the concentrations of the second, third . . . picture images also become incorrect. In order to eliminate such drawback, in accordance with the invention, provision is made for the bias correction variable resistor 24. The bias correction variable resistor 24 may be mounted on an operation panel exposed to the outside of the electrographic apparatus and can manually be operated by an operator so as to adjust the bias voltage.

If the picture image concentration of the first copy is not correct, the operator can adjust the variable resistor 24 in a direction and range which are determined in dependence with the first picture image concentration and hence obtain a second copy having a correct picture image. Then, a desired number of copies set beforehand each having a correct picture quality can be obtained. The variable resistor 24 may be replaced by a change-over switch 31 which can change-over resistors 28, 29 and 30 as shown in FIG. 3.

As seen from the above, the electrographic apparatus according to the invention is also capable of selectively changing an concentration of the picture image of the intermediate copy by adjusting the variable resistor 24 shown in FIG. 3.

Figure 4A:
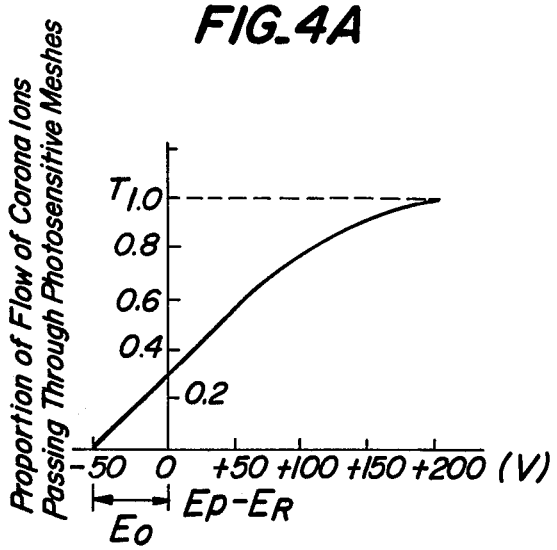
FIG. 4A is a graph showing curve of a potential difference between a surface potential on an electrostatic latent image and bias voltage as a function of proportion of a flow of corona ions passing through photosensitive meshes.

In FIG. 4A is shown a graph showing a curve of a potential difference $E_p$-$E_R$ as a function of the proportion of a flow of corona ions passing through the photosensitive meshes (a relative concentration of a picture image). In the potential difference $E_p$-$E_R$, $E_p$ is an electrostatic latent image potential produced on the photosensitive layer 4 and building up an electric field which can promote the passage of the flow of corona ions through the photosensitive screen and $E_R$ is a bias voltage applied between the two electrically conductive layers 1, 3 and preventing the flow of corona ions from passing through the photosensitive screen. In practice, in order to completely intercept the flow of corona ions through 200 screen mesh, for example, the potential difference $E_p$-$E_R$ must be of the order of +50 V as shown in FIG. 4A owing to the presence of an electric field built up by the corona discharge device and an electric field (0.5 to 1 kv/mm) applied between the photosensitive screen and the field electrode.

In FIG. 4A, the value of the potential difference $E_p$-$E_R$ which can completely intercept the flow of corona ions is given by $E_0$. This shows that, even when the electrostatic latent image potential $E_p$=0 V, a bias voltage of the order of 50 V is required in order to completely intercept the flow of corona ions. In addition, if the electrostatic latent image potential is added to the residual potential, use must be made of a bias voltage composed of at least the residual potential $+E_0$.

Figure 4B:
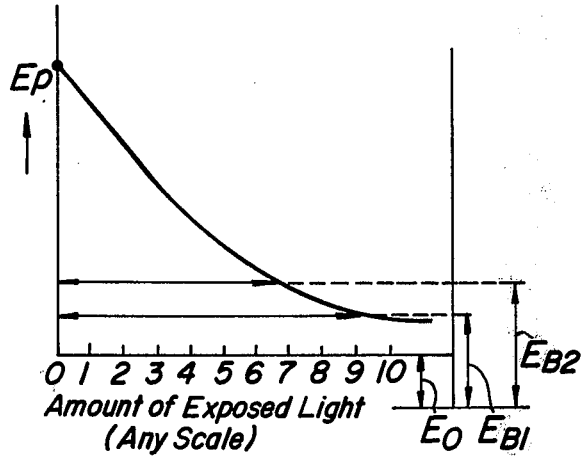
FIG. 4B is a graph showing a characteristic curve of amount of exposed light as a function of electrostatic latent image potential $E_p$ and showing range of utilization of bias voltage along the characteristic curve.

In FIG. 4B is shown a graph showing a characteristic curve of the amount of exposed light to photosensitive layer formed of Se as a function of electrostatic latent image potential $E_p$ and showing the range of utilization of the bias voltage in the characteristic curve. If the residual potential is not present in the imagewise exposed area of the photosensitive layer, it is possible to obtain a picture image which is not over developed by making the bias voltage $E_R$ equal to $E_0$. In practice, however, the residual potential is present in the imagewise exposed area of the photosensitive layer, so that the lowest bias voltage $E_{B1}$ required for obtaining the correct picture image must be equal to $E_0$ plus the residual potential. In this case, a reproduced picture image has a concentration tone within a range shown by 1 in FIG. 4B. If the bias voltage is made equal to $E_{B2}$ which is higher than $E_{B1}$, the lowest voltage within which the flow of corona ions can pass through the photosensitive screen becomes higher than the residual voltage. As a result, a reproduced picture image has a concentration tone within a range shown by 2 in FIG. 4B. In the range 1, the portion reproducing the concentration tone increases slowly and hence it is possible to reproduce copies which are rich in harmony. In the range 2, the portion producing the concentration tone increases sharply and hence can reproduce copies each having a good contrast.

As a result, the range 1 is suitable for reproducing photographs or faint letters, etc. each having a poor contrast and the range 2 is suitable for reproducing clear letters, etc. each having a good contrast.

As stated hereinbefore, the use of the bias adjusting variable resistor 24 or the bias adjusting change-over switch 31 mounted on the operation panel of the electrographic apparatus ensures a change of the bias voltage and provides the important advantage that the concentration tone reproduction characteristic of the picture image to be reproduced can be selected.

Figure 5:
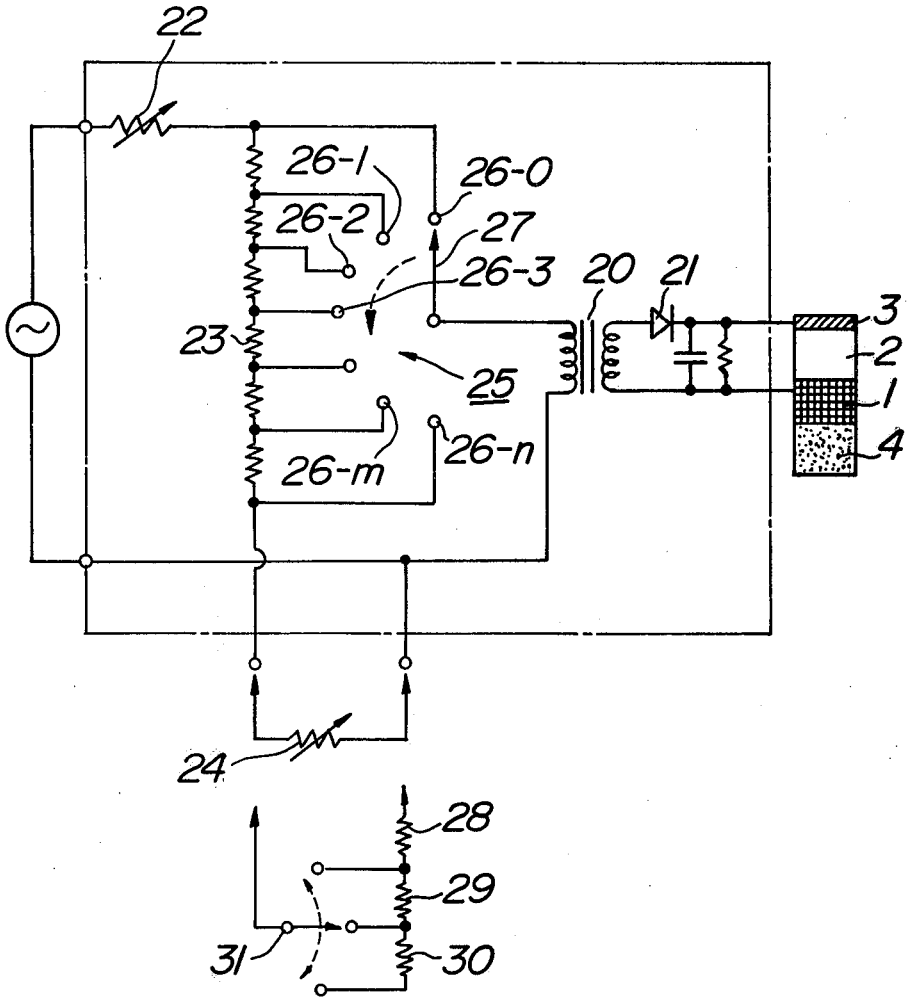
FIG. 5 is a circuit diagram of another embodiment of an electrographic apparatus according to the invention.

The invention is not limited to the above described embodiments, but many changes and alternations may be made. For example, as shown in FIG. 5, the bias voltage may be changed at the primary winding side of the bias electric source transformer 20.

What is claimed is:

1. In an electrographic apparatus comprising a photosensitive screen composed of an insulating layer, two electrically conductive layers coated on opposite sides of said insulating layer and a photosensitive layer coated on one of said electrically conductive layers, a corona discharge device arranged at one side of said photosensitive screen and emitting a flow of corona ions, and a dielectric coated record sheet arranged at the other side of said photosensitive screen, whereby an electrostatic latent image produced on said photosensitive layer of said photosensitive screen causes said flow of corona ions directed from said corona discharge device through said photosensitive screen toward said dielectric coated record sheet to modulate so as to produce, on said dielectric coated record sheet, an electrostatic charge image corresponding to said electrostatic latent image on said photosensitive layer of said photosensitive screen, the improvement comprising means for adjusting a bias voltage applied between said two electrically conductive layers of said photosensitive screen and including a variable resistor connected in series with a voltage dividing resistor connected across a bias voltage electric source transformer.

2. The apparatus according to claim 1, wherein said means for adjusting said bias voltage is mounted on an operation panel exposed to the outside of said electrographic apparatus.

3. The apparatus according to claim 1, wherein said means for adjusting said bias voltage is manually operable.

4. In an electrographic apparatus comprising a photosensitive screen composed of an insulating layer, two electrically conductive layers coated on opposite sides of said insulating layer and a photosensitive layer coated on one of said electrically conductive layers, a corona discharge device arranged at one side of said photosensitive screen and emitting a flow of corona ions, and a dielectric coated record sheet arranged at the other side of said photosensitive screen, whereby an electrostatic latent image produced on said photosensitive layer of said photosensitive screen causes said flow of corona ions directed from said corona discharge device through said photosensitive screen toward said dielectric coated record sheet to modulate so as to produce, on said dielectric coated record sheet, an electrostatic charge image corresponding to said electrostatic latent image on said photosensitive layer of said photosensitive screen, the improvement comprising means for adjusting a bias voltage applied between said two electrically conductive layers of said photosensitive screen and including a change-over switch connected in series with a voltage dividing resistor connected across a bias voltage electric source transformer and change-over resistors connected in series with said voltage dividing resistor.

5. The apparatus according to claim 4, wherein said means for adjusting said bias voltage is mounted on an operation panel exposed to the outside of said electrographic apparatus.

6. The apparatus according to claim 4, wherein said means for adjusting said bias voltage is manually operable.

7. In an electrographic apparatus comprising a photosensitive screen composed of an insulating layer, two electrically conductive layers coated on opposite sides of said insulating layer and a photosensitive layer coated on one of said electrically conductive layers, a corona discharge device arranged at one side of said photosensitive screen and emitting a flow of corona ions, and a dielectric coated record sheet arranged at the other side of said photosensitive screen, whereby an electrostatic latent image produced on said photosensitive layer of said photosensitive screen causes said flow of corona ions directed from said corona discharge device through said photosensitive screen toward said dielectric coated record sheet to modulate so as to produce, on said dielectric coated record sheet, an electrostatic charge image corresponding to said electrostatic latent image on said photosensitive layer of said photosensitive screen, the improvement comprising means for adjusting a bias voltage applied between said two electrically conductive layers of said photosensitive screen, said means for adjusting said bias voltage being automatically operable in response to the amount of light in an optical path.

* * * * *